United States Patent [19]

Paul

[11] 4,401,708

[45] Aug. 30, 1983

[54] NONWOVEN FABRIC AND METHOD OF BONDING SAME USING MICROWAVE ENERGY AND A POLAR SOLVENT

[75] Inventor: Thomas R. Paul, Naperville, Ill.

[73] Assignee: Standard Oil Company (Indiana), Chicago, Ill.

[21] Appl. No.: 327,791

[22] Filed: Dec. 7, 1981

[51] Int. Cl.[3] ..... B05D 3/02; B05D 5/10; D04H 1/54; D04H 1/64

[52] U.S. Cl. ..... 428/198; 427/45.1; 427/207.1; 428/296

[58] Field of Search ..... 428/195, 296, 198; 427/45, 207.1

[56] References Cited

U.S. PATENT DOCUMENTS 3,053,609 9/1962 Miller .

3,949,111 4/1976 Pelletier .

*Primary Examiner*—James C. Cannon

*Attorney, Agent, or Firm*—Robert R. Cochran; William T. McClain; William H. Magidson

[57] ABSTRACT

A method of producing a nonwoven fabric from a web of fibers, said fibers being substantially nonreactive to microwave energy, comprising applying a microwave reactive material to fibers in said web, subjecting the web to microwave energy at a temperature and for a time to heat said microwave reactive material sufficiently to cause bonding at at least some of the fiber intersections in said web thereby producing a nonwoven web. The resulting nonwoven fabric has a number of uses and is especially suitable as primary carpet backing.

9 Claims, 4 Drawing Figures

Figure 1:
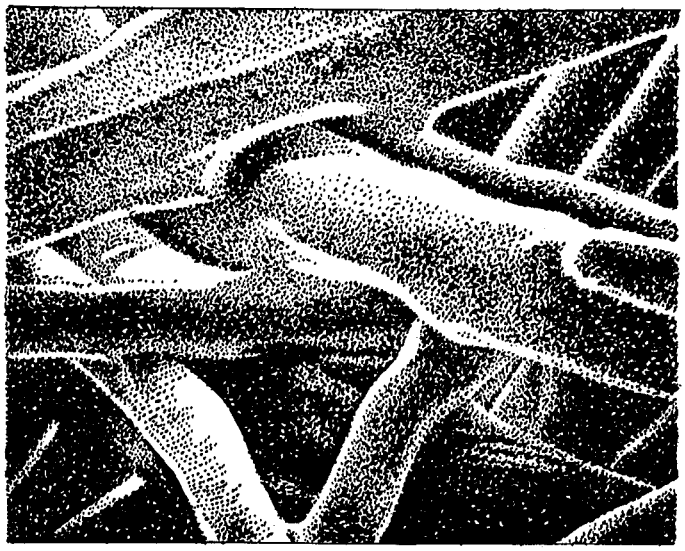

NONWOVEN FABRIC AND METHOD OF BONDING SAME USING MICROWAVE ENERGY AND A POLAR SOLVENT

This invention relates to the bonding of fibers, said term including continuous filaments, staple and yarns thereof, to produce nonwoven fabrics. Such materials find use as filter pads, road construction material, wall paper, plaster backing, lining fabrics, drapery fabrics and other textile and industrial applications. It is believed that the fabrics of this invention are particularly well suited as primary carpet backing for use by the tufted carpet manufacturer. For a nonwoven fabric to be used as a primary carpet backing, it must have good integrity and must not be cut or damaged during the tufting process. In terms of the fabric, this means that the fibers should have and retain substantial tenacity and that the bonds between the fibers should be weaker than the fibers so that the fibers can move away from the tufting needle and avoid being cut. This invention satisfies the requirements for primary carpet backing in that the bonds formed involve only the surface of the fibers and thus do not cause a substantial loss of fiber tenacity. The nonwoven material has good integrity and the bonds are weaker than the individual fibers.

A number of fiber bonding processes for the production of nonwoven fabrics have been developed over the years. One example is shown in Miller U.S. Pat. No. 3,053,609 (1962). The fabric is treated with a mixture of a solvent for the fiber mixed with an inert extender, the latter being of substantially high molecular weight such that it is initially soluble with the solvent but is subsequently capable of being insolubilized. An example of a solvent for polyester is trichloroacetic acid and extenders include liquid and solid polyethylene oxides. The mixture is applied to the fibers followed by heating and subsequently washing to remove the extender and solvent.

Another bonding system is represented by Findlay et al. U.S. Pat. No. 3,231,650 (1966) wherein a hydrocarbon oil solvent is applied to a polyolefin fiber web to produce a nonwoven product. Conventional heating is used to bond the treated fiber web. It will be noted that the solvents suggested are not microwave active.

The use of an electric field in a fiber bonding process is shown in Pelletier U.S. Pat. No. 3,949,111 (1976). The fibers are placed under compression and exposed to the electric field, a frequency of 27 Mhz being suggested.

An object of this invention is to provide improved nonwoven fabrics. A further object of this invention is to provide a new method of producing nonwoven fabrics wherein a web of fibers is treated with a microwave active material and subsequently exposed to microwave radiation. A further object of this invention is to provide an improved primary backing for use in the tufted carpet industry. Other objects and advantages of this invention will be apparent to those skilled in the art upon reading this disclosure.

Broadly, the invention resides in a method of producing a nonwoven fabric from a web of fibers, said fibers being substantially nonreactive to microwave energy, comprising applying a microwave reactive material to fibers in said web, subjecting the web to microwave energy at a temperature and for a time to heat said microwave reactive material sufficiently to cause bonding at at least some of the fiber intersections in said web thereby producing a nonwoven web and the fabric produced thereby. The fabric is characterized by bonds between fibers which are weaker than the fibers and that the fibers are not substantially of less tenacity at bond points than at other points in the fabric.

It is believed that the present invention will find its greatest use in the production of nonwoven fabrics containing polyester and nylon fibers.

As stated, the process involves exposing the fiber to a liquid solvent or other microwave active material and subjecting the wet web of fibers to microwave radiation. Microwave radiation is generally considered to be radiation in the frequency spectrum from 640 to 10,000 Mhz. Most commercial microwave ovens operate at 2450 Mhz and such a frequency was used in the work reported herein.

Solvents used are selected to have a solubility parameter close to the solubility parameter of the fiber. As used herein, the solubility parameter, sometimes referred to as the Sp value, is defined as the square root of the cohesion energy density (cal/cc) as described in "Polymer Handbook" chapter 4, compiled by J. Brandrup and E. H. Immergut, second edition, published 1975 by John Wyley & Sons, Inc. The solubility parameter of commercial polyester is in the range of 7.4 to 14.7 and for nylon is in the range of 7.8 to 14.5. Thus, any liquid or mixture thereof which has a solubility parameter in the ranges for these resins and which has sufficient polarity to be heated by microwave radiation can be used. Examples of such solvents, with the solubility parameter being shown in parenthesis, include n-amyl amine (8.7), butyl amine (8.7), butyl bromide (8.7), propyl bromide (8.9), benzaldehyde (9.4), nonyl phenol (9.4), nitrobenzene (10.0), m-cresol (10.2), benzyl alcohol (12.1), diacetyl piperazine (13.7), methyl ethyl sulfone (13.4), chloro acetonitrile (12.6), and ethyl acetamide (12.3).

In addition to liquid solvents, microwave active gases and solids can also be used provided they function to generate surface heating of the fibers to be bonded without causing complete fiber heating which would reduce the fiber tenacity.

Surface treatment of the fibers or web thereof can be used to improve the receptivity to the solvent with subsequent improvement in the web following microwave radiation. These pretreatments can include chemical treatments such as are obtained with chromic acid, hydrogen peroxide and ozone. Further, the pretreatment can be carried out by subjecting the fibers to a corona discharge or an oxidizing flame. In work reported herein, the corona discharge treating system of Alvin S-Mancib Company, Model PT-20, was used. This is a 0.7 CVA unit which can be operated within the range of 2 to 8 amperes and 200 to 400 volts. The alternator was a Model 50-2617.

Accompanying and forming a part of this disclosure is a drawing comprising

Figure 4:
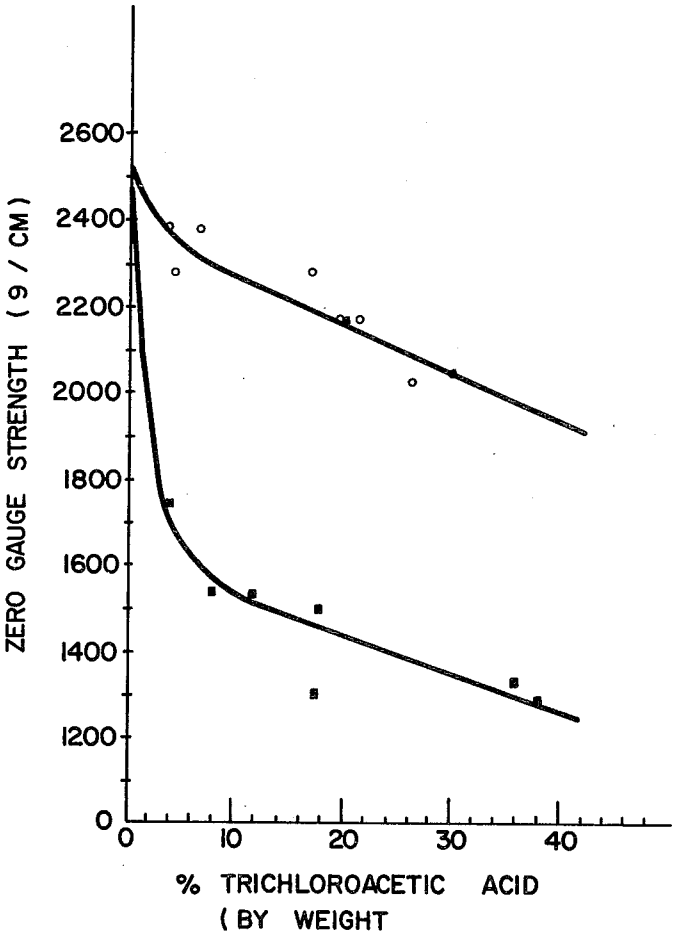

FIG. 1, a microphotograph of a fabric treated with trichloroacetic acid and subsequently heat bonded, FIG. 2, a microphotograph of a fabric treated with 20 percent by weight trichloroacetic acid and microwave bonded, FIG. 3, a graph showing cut strip tensile strength of microwave and heat bonded web, and FIG. 4 showing gauge tensile strength for the same bonded webs.

The microwave active coating is applied by adjusting temperature and length of time so that the fibers do not lose tenacity because of melting, relaxation, pitting or etching. Room temperature or elevated temperatures are suitable and the time can range from 5 to 200 minutes. Obviously, shorter periods of time at higher temperatures can be used and some experimentation may be necessary to obtain the optimum treating time and temperature. This can easily be developed by making a few runs with the particular fiber and treating agent to be used.

The length of time for the exposure to microwave radiation can range from 2 to 25 minutes and again, preliminary runs may be desirable to determine optimum operation. The power of the mocrowave oven should be such to bring the fibers to the bonding temperature, this ranging from 200 to 2,000 watts. The length of heating period is not critical when the microwave active coating is a liquid or a gas because the heating rate will slow markedly after the coating has been volatilized from the fiber and the bonds are formed. Greater care is necessary for operations using a solid coating.

The following examples illustrate specific embodiments of the invention, but they should not be considered unduly limiting.

EXAMPLE I

Several runs using microwave bonding are illustrated. Tables I and II summarize the pertinent information about the bonding conditions.

TABLE I

| Run No. | Corona Treatment | Active Coating | Application Temp. | Application Time (min.) |
|---|---|---|---|---|
| 1 | No | Benzyl Alcohol | R.T. | 10 |
| 2 | No | Nitro Benzene | R.T. | 30 |
| 3 | Yes | m-cresol | R.T. | 60 |
| 4 | No | m-cresol | R.T. | 60 |

TABLE II

| Run No. | Microwave Heating Power (watts) | Microwave Heating Time (min.) | Results |
|---|---|---|---|
| 1 | 600 | 8 | Some Bonding |
| 2 | 600 | 8 | Some Bonding |
| 3 | 600 | 7 | Well Bonded |
| 4 | 600 | 7 | Good Bonding |

In these runs, a 4 ounce per square yard web of 12 denier poly(ethylene terephthalate) fibers was used. A square of the web 1.5 to 2 inches on a side, with or without the corona discharge treatment, was soaked in a Petri dish of microwave active compound for the specified time. After soaking the web was blotted to remove excess coating and put into the microwave oven on a glass grid. A Litton model 418 microwave oven that operates at 2450 Mhz was used.

Of the four runs of this example, Runs 1, 2, and 4 did not appear to have sufficient uniformity to give meaningful tensile or bond distribution data. However, microscopic examination of the bonded web showed their bonding to be qualitatively the same as the bonding in Run 3. Run 3 had sufficient uniformity to be characterized.

Characterization of Run 3

1. Tensile Strength—The tensile strength of Run 3 and of the starting web were measured on a microtensile tester. The tensile strength of several nonwovens were also measured for comparison. These data are shown in Table III (the strip size for this test was 3.175×25 mm, the gauge length was 15 mm, and the crosshead speed was 4 mm/min).

TABLE III

TENSILE STRENGTH by MICROTENSILE TEST

| Non-woven | Weight (oz/yd$^2$) | Load at Break | Elongation at Break (%) | Normalized Load at Break (lb/in/oz/yd$^2$) |
|---|---|---|---|---|
| Run 3 | 4.0 | 10.24 | 6.4 | 2.59 |
| Starting Web* | 4.0 | ~0 | — | ~0 |
| Lutradur | 3.8 | 8.55 | 17.7 | 2.26 |
| Typar | 3.1 | 9.28 | 10.7 | 2.97 |
| K-12 Colback | 3.8 | 14.99 | 29.7 | 3.91 |

*Did not have enough strength to load into the tester.

As is seen, the starting web had no strength while Run 3 had strength comparable to other commercial nonwovens.

2. Bond Strength Distribution—The strength and relative number of bonds in Run 3 were measured by slowly delaminating (1 mm/min) a test strip on the microtensile tester. The relative number of each strength bond is shown in Table IV.

TABLE IV

BOND STRENGTH DISTRIBUTION OF RUN 3

| Bond Strength Range (gm) | Bond Count (Bonds/mm$^2$) |
|---|---|
| 0.0–0.5 | 0.71 |
| 0.5–1.0 | 0.50 |
| 1.0–1.5 | 0.13 |
| 1.5–2.0 | 0.21 |
| 2.0–2.5 | 0.08 |
| 2.5–3.0 | 0.04 |
| 3.0–3.5 | 0.0 |
| 3.5–4.0 | 0.04 |
| 4.0–4.5 | 0.04 |
| 6.5–7.0 | 0.08 |
| 10.0–10.5 | 0.04 |
| Total Bond Density | 1.87 bonds/mm$^2$ |

The strength of an individual fiber from the starting web is about 35 gm, while the strongest bond in Run 3 is about 10 gm or only about $\frac{1}{3}$ of the fiber strength. Thus, it is seen that the fibers in this fabric should not be cut during tufting since the bonds will break first allowing the fiber to move away from the tufting needle.

EXAMPLE II

Web—The same unbonded web was used for all of the runs reported in this example. This web was a carded web composed of 6 denier by 3 inch polyester fiber. The web weight was approximately 2.5 oz/yd$^2$.

Bonding Procedure—The same procedure was used for coating all of the webs in preparation for bonding. Starting with the unbonded web, a 2.75 inch diameter sample was cut from it using a J. A. King Co. Model 3090AC sample cutter. After the web was weigned, it was put onto the glass frit and coated with a solution of known trichloroacetic acid concentration, a material having approximately the same solubility parameter as that of the polyester. The wet web was then reweighed and put on a glass frit in the microwave oven. After the wet web was put on the frit, a circular disc of either glass or polyethylene was put on top of it.

A piece of latex rubber sheeting was then put on top of the whole frit assembly to make it reasonably vacuum tight. A vacuum was then applied to the frit assembly so that the wet web was squeezed between the disc and frit with a pressure of about 1 atmosphere. After the vacuum was applied, the microwave power was turned on. In all cases of microwave bonded samples, 600 watts of microwave power were used for eight minutes with a polyethylene disc.

In several instances, conventional heating was used in the place of microwave heating. The conventional heating was done by heating the glass frit and glass disc to about 110° C. in the microwave oven. After the frit and disc were hot, the wetted web was put between them in the usual manner but the microwave power was not turned on.

Data describing the preparation of all of the runs are given in the Table V.

TABLE V

| | PART 1 | | | PART 2 | | |
|---|---|---|---|---|---|---|
| Run No. | Web Wt. (mg.) | Solution Composition (% Acid by Wt.) | Web & Soln. Wt. (mg.) | % Acid (By Wt.) | Disc Used | Bonding Initiated |
| 1 | 333 | 20.0 | 618 | 17.1 | Glass | Heat |
| 2 | 388 | 20.0 | 727 | 17.5 | Glass | Heat |
| 3 | 349 | 20.0 | 691 | 19.6 | Glass | Heat |
| 4 | 325 | 20.0 | 512 | 11.5 | Glass | Heat |
| 5 | 368 | 20.0 | 757 | 21.1 | PE | Microwave |
| 6 | 363 | 20.0 | 667 | 16.7 | PE | Microwave |
| 7 | 365 | 20.0 | 716 | 19.2 | PE | Microwave |
| 8 | 349 | 9.1 | 595 | 6.4 | PE | Microwave |
| 9 | 325 | 9.1 | 476 | 4.2 | PE | Microwave |
| 10 | 347 | 9.1 | 474 | 3.3 | PE | Microwave |
| 11 | 368 | 9.1 | 520 | 3.8 | PE | Microwave |
| 12 | 323 | 9.1 | 514 | 4.2 | PE | Microwave |
| 13 | 362 | 30.0 | 782 | 34.8 | PE | Microwave |
| 14 | 322 | 30.0 | 566 | 22.7 | PE | Microwave |
| 15 | 330 | 30.0 | 659 | 30.0 | PE | Microwave |
| 16 | 364 | 30.0 | 679 | 26.0 | PE | Microwave |
| 17 | 348 | 30.0 | 650 | 26.0 | PE | Microwave |
| 18 | 356 | 30.0 | 1010 | 55.1 | PE | Microwave |
| 19 | 378 | 30.0 | 858 | 38.1 | Glass | Heat |
| 20 | 361 | 30.0 | 792 | 35.8 | Glass | Heat |
| 21 | 334 | 30.0 | 422 | 7.9 | Glass | Heat |
| 22 | 314 | 9.1 | 443 | 3.7 | Glass | Heat |
| 23 | 336 | 30.0 | 1389 | 94.0 | PE | Microwave |
| 24 | 370 | 20.0 | 628 | 13.9 | PE | Microwave |
| 25 | 322 | 20.0 | 606 | 17.6 | PE | Microwave |

Physical Testing

All of the physical properties data were taken on an Instron Model TM tester using the compression tension cell. In all instances the tensile samples were ½ inch wide by 3 inches long. A 2 inch gauge length was used and the webs were pulled at a rate of 2 inches/minute. The data recorded from the stress-strain curve are load at break, elongation at break, and initial modulus, both of duplicate tests being reported.

The zero gauge length tensile tests were performed in the same manner as the other tensile tests with the exception that a zero gauge length was used instead of a 2 inch gauge length.

The tear strengths were measured according to ASTM 02261.

Figure 3:
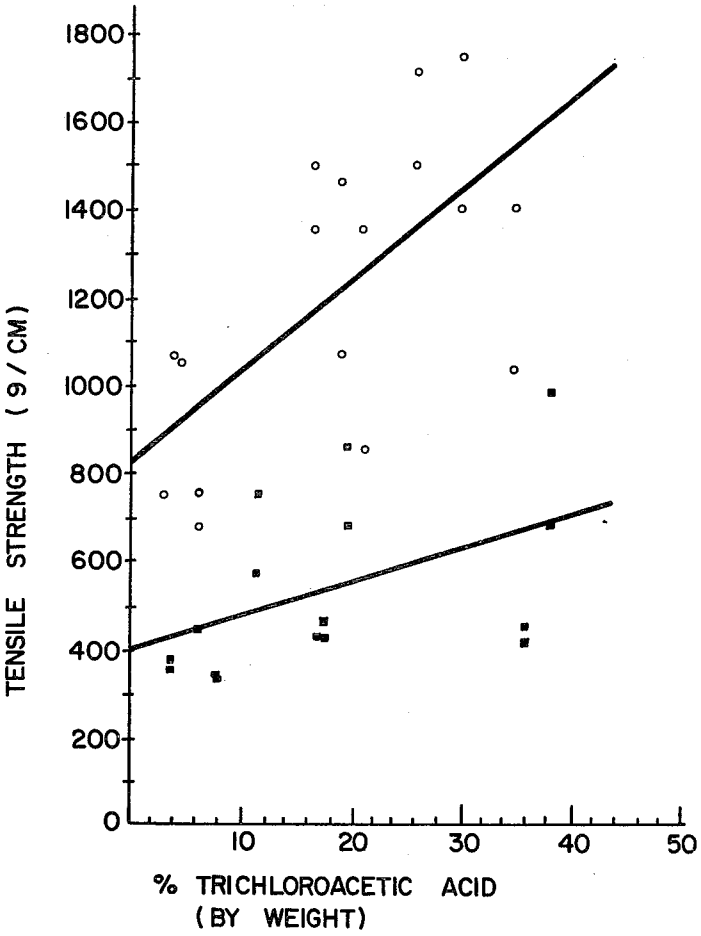

The results are tabulated in Table VI and plotted in FIGS. 3 and 4.

TABLE VI

| | PART 1 | | | PART 2 | | |
|---|---|---|---|---|---|---|
| Run No. | % Acid (By Wt.) | Tensile (gm/cm) | Zero Gauge (gm/cm) | Elongation At Break (%) | Modulus (lb/in/in) | Tear (gm) |
| 1 | 17.1 | 572 + 429 | 1394 | — | — | — |
| 2 | 17.5 | 429 + 465 | 1787 | — | — | — |
| 3 | 19.6 | 858 + 679 | 3146 | — | — | — |
| 4 | 11.5 | 572 + 751 | 1859 | — | — | — |
| 5 | 21.1 | 858 + 1358 | 3146 | 9.0 + 12.6 | 62.3 + 73.0 | — |
| 6 | 16.7 | 1358 + 1501 | 3360 | 19.5 + 17.5 | 43.0 + 55.0 | — |
| 7 | 19.2 | 1072 + 1466 | 3146 | 11.4 + 15.9 | 52.0 + 53.5 | — |
| 8 | 6.4 | 751 + 679 | >3575 | 24.0 + 22.4 | 37.5 + 35.4 | — |
| 9 | 4.2 | — | — | — | — | 320 |
| 10 | 3.3 | 751 + 751 | >3575 | 25.6 + 24.0 | 22.5 + 25.5 | — |
| 11 | 3.8 | — | — | — | — | 343 |
| 12 | 4.2 | 1072 + 1072 | 3360 | 30.5 + 26.0 | 42.0 + 30.5 | — |
| 13 | 34.8 | 1401 + 1037 | — | 10.4 + 13.6 | 49.0 + 28.5 | — |
| 14 | 22.7 | — | — | | | 336 |
| 15 | 30.0 | 1401 + 1752 | 2896 | 16.9 + 20.1 | 38.5 + 45.5 | — |
| 16 | 26.0 | — | — | | | 256 |
| 17 | 26.0 | 1501 + 1716 | 2860 | 14.6 + 4.0 | 62.5 + 62.8 | — |
| 18 | 55.1 | 1205 + 1351 | 3182 | — | — | — |
| 19 | 38.1 | 983 + 679 | 1369 | — | — | — |
| 20 | 35.8 | 443 + 415 | 1451 | — | — | — |
| 21 | 7.9 | 340 + 334 | 1877 | — | — | — |
| 22 | 3.7 | 357 + 375 | 2288 | — | — | — |
| 23 | 94.0 | 1058 + 1260 | 2502 | — | — | — |

TABLE VI-continued

| Run No. | % Acid (By Wt.) | PART 1 Tensile (gm/cm) | PART 1 Zero Gauge (gm/cm) | PART 2 Elongation At Break (%) | PART 2 Modulus (lb/in/in) | PART 2 Tear (gm) |
|---|---|---|---|---|---|---|
| 24 | 13.9 | — | — | — | — | 359 |
| 25 | 17.6 | — | — | — | — | 263 |

Discussion of Results

The easiest to interpret data measured was the cut strip tensile strength. These data for both the microwave bonded fabrics (open circles) and conventional heat bonded fabric (block dots) are shown in FIG. 3. Clearly, the microwave bonded fabrics are much stronger than the conventional heat bonded fabrics.

Additionally, it was found that the greatest weight of trichloroacetic acid that could be used for conventional heating was about 38 percent; beyond this point, totally fused film-like areas appeared in the fabric. With microwave heating, on the other hand, as much as 100 percent by weight trichloroacetic acid can be used without the appearance of fused or film-like areas in the resulting fabric.

A second, very pertinent type of measurement made on the microwave and conventional heat bonded samples is the zero gauge strength. In this type of tensile test, the jaws of the tester are moved next to one another as closely as possible so that a gauge length of zero is approximated. The assumption is then made that all of the fibers in the gauge area are clamped by both grips. Thus, upon extension, the recorded tensile force should represent the strength of the fibers and have nothing to do with the amount of bonding present.

From the zero gauge tensile data presented in FIG. 4, it is apparent that conventional bonding damages the fiber much more than microwave bonding. FIG. 4 shows that almost 50 percent of the inherent strength of the polyester fibers is lost by even the most modestly bonded fabric when conventional heat is used (black slots). On the other hand, microwave bonded fabrics using low weight trichloroacetic acid retain most of their initial fiber strength (open circles).

Figure 2:
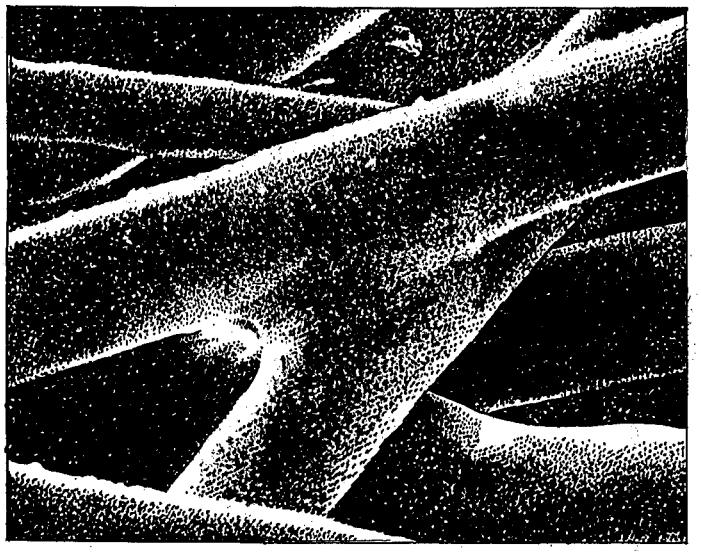

The scanning electron micrographs of fabrics bonded by the two different methods presented in FIGS. 1 and 2, help explain the zero gauge data. FIG. 1 shows a section of fabric conventionally heat bonded at 27 percent by weight trichloroacetic acid. From the Figure it is apparent that there are numerous bonds between fibers; however, it is also apparent that there are large indentations in some of the fibers at the bonded points and that a number of the fibers appear to be limp and tend to wrap over adjacent fibers. As a contrast, FIG. 2 shows that the microwave bonded fibers appear to be stiff and straight and do not show indentations at their bond points.

When considered together, the zero gauge tensile data and the scanning electron micrographs show that bonding with microwave power is fundamentally different than bonding with conventional heat. To begin with, the polyester fiber would have a uniform and homogeneous cross section. Upon application of the trichloroacetic acid the fiber would have a uniform but nonhomogeneous cross section with the center of the fiber remaining unaffected while the outer sheath of the fiber should have absorbed the trichloroacetic acid. The thickness of the outer sheath undoubtedly depends on the amount of trichloroacetic acid added. Since conventional heating is not selective, both the core of the fiber and the sheath with the absorbed trichloroacetic acid are heated simultaneously, which results in a thickening of the trichloroacetic acid absorbed sheath before the acid is ultimately volatilized off. As a consequence of the migration of the trichloroacetic acid into the core of the fiber, the fiber loses orientation and attendant physical properties.

With microwave heating the fiber behaves differently. When microwave power is applied to the fiber it selectively heats only the trichloroacetic acid in the sheath while leaving the core of the fiber unheated. As a result of this selective heating the trichloroacetic acid has little tendency to migrate further into the core but is volatilized out of the sheath.

EXAMPLE III

This represents an example of the prior art. The treating procedure of Example 7 of Miller U.S. Pat. No. 3,053,609 was repeated. In this work, the carded web of fibers was treated with a solution made by dissolving three grams of polyethylene oxide (WSR 301) and 20 grams of trichloroacetic acid in a mixture of 240 milliliters of isopropyl alcohol and 60 milliliters of water. This was applied to the polyethylene terephthalic web so that a wet pick-up of 100 percent was obtained. The web was then dried in an oven at 120° C. for 15 minutes and subsequently scoured in water at 50° C. until all the polyethylene oxide and trichloroacetic acid were removed. No bonding was obtained.

It will be apparent to those skilled in the art that variations and modifications of the invention can be made from a study of the foregoing disclosure. Such variations and modifications are believed to be clearly within the spirit and scope of the invention.

We claim:

1. A method of producing a nonwoven fabric from a web of fibers, said fibers being substantially nonreactive to microwave energy, comprising applying a solvent having (1) sufficient polarity to be heated by microwave radiation and (2) a solubility parameter close to the solubility parameter of the fibers of the web to fibers in said web, subjecting the web to microwave energy at a temperature and for a time to heat said microwave heatable solvent sufficiently to cause bonding at at least some of the fiber intersections in said web thereby producing a nonwoven web.

2. The method of claim 1 wherein said fibers are at least in part polyester resin fibers.

3. The method of claim 1 wherein said fibers are at least in part polyamide resin fibers.

4. The method of claim 1 wherein said web is given a pretreatment to improve receptivity of fibers in the web to the microwave reactive material.

5. The method of claim 4 wherein said pretreatment is exposure to corona discharge.

6. The method of claim 4 wherein said pretreatment is exposure to UV light.

7. The method of claim 4 wherein said pretreatment is chemical etching.

8. The method of claim 1 wherein said solvent is benzyl alcohol, nitro benzene, m-cresol, or trichloroacetic acid.

9. A nonwoven fabric having individual fibers bonded at intersections by bonds weaker than the fibers, the tenacity of the fibers being not substantially less at bond points than at other points in the fiber.

* * * * *

UNITED STATES PATENT OFFICE
CERTIFICATE OF CORRECTION

Patent No. 4,401,708 Dated August 30, 1983

Inventor(s) Thomas R. Paul

It is certified that error appears in the above-identified patent and that said Letters Patent are hereby corrected as shown below:

Column 3, line 12 reads "mocrowave" should read --microwave-- per

Column 4, line 61 reads "weigned" should read --weighed-- per

Table VI, Part II, under "Elongation at Break (%)", Run. No. 17 reads "14.6 + 4.0" should read --14.6 + 14.0--

Signed and Sealed this

*Twentieth* Day of *November 1984*

[SEAL]

*Attest:*

GERALD J. MOSSINGHOFF

*Attesting Officer*

*Commissioner of Patents and Trademarks*